US009580848B2

(12) United States Patent
Henderson et al.

(10) Patent No.: US 9,580,848 B2
(45) Date of Patent: Feb. 28, 2017

(54) APPARATUS AND METHODS FOR PRODUCING NONWOVEN FIBROUS WEBS

(71) Applicant: 3M INNOVATIVE PROPERTIES COMPANY, St. Paul, MN (US)

(72) Inventors: John W. Henderson, St. Paul, MN (US); Tien T. Wu, Woodbury, MN (US); Gustavo H. Castro, Cottage Grove, MN (US); Gerry A. Hoffdahl, Scandia, MN (US); David L. Vall, Woodbury, MN (US)

(73) Assignee: 3M INNOVATIVE PROPERTIES COMPANY, St. Paul, MN (US)

( * ) Notice: Subject to any disclaimer, the term of this patent is extended or adjusted under 35 U.S.C. 154(b) by 336 days.

(21) Appl. No.: 14/368,540

(22) PCT Filed: Dec. 21, 2012

(86) PCT No.: PCT/US2012/071177

§ 371 (c)(1),
(2) Date: Jun. 25, 2014

(87) PCT Pub. No.: WO2013/101717

PCT Pub. Date: Jul. 4, 2013

(65) Prior Publication Data

US 2015/0021805 A1 Jan. 22, 2015

Related U.S. Application Data

(60) Provisional application No. 61/581,960, filed on Dec. 30, 2011.

(51) Int. Cl.
*D04H 1/732* (2012.01)
*D04H 1/44* (2006.01)
(Continued)

(52) U.S. Cl.
CPC ..... *D04H 1/736* (2013.01); *D04H 1/44* (2013.01); *D04H 1/49* (2013.01); *D04H 1/732* (2013.01)

(58) Field of Classification Search
CPC .. D04H 1/44; D04H 1/49; D04H 1/72; D04H 1/732; D04H 1/736; D01G 25/00
See application file for complete search history.

(56) References Cited

U.S. PATENT DOCUMENTS 3,252,186 A * 5/1966 Oja ..... B27N 3/14 19/305
3,792,943 A 2/1974 Helgesson
(Continued)

FOREIGN PATENT DOCUMENTS

JP H11-152668 A 6/1999
JP 2002-509207 A 3/2002
(Continued)

OTHER PUBLICATIONS

Davies, "The Separation of Airborne Dust and Particles", Institution of Mechanical Engineers, London Proceedings, 185-212 (1952).
(Continued)

*Primary Examiner* — Jose Fortuna
(74) *Attorney, Agent, or Firm* — James A. Baker

(57) ABSTRACT

Methods and apparatus including a fiber opening chamber having an open upper end and a lower end, at least one fiber inlet for introducing a multiplicity of fibers into the opening chamber, a first multiplicity of rollers positioned within the opening chamber wherein each roller has a multiplicity of projections extending outwardly from a circumferential surface surrounding a center axis of rotation, at least one gas emission nozzle positioned substantially below the first multiplicity of rollers to direct a gas stream generally towards the open upper end of the opening chamber, and a forming chamber having an upper end and a lower end,
(Continued)

wherein the upper end of the forming chamber is in flow communication with the open upper end of the opening chamber, and the lower end of the forming chamber is substantially open and positioned above a collector having a collector surface.

20 Claims, 2 Drawing Sheets

(51) Int. Cl.
*D04H 1/736* (2012.01)
*D04H 1/49* (2012.01)

(56) References Cited

U.S. PATENT DOCUMENTS 3,802,817 A 4/1974 Matsuki
4,100,324 A 7/1978 Anderson
4,640,810 A 2/1987 Laursen
4,818,464 A 4/1989 Lau
5,114,787 A 5/1992 Chaplin
5,167,765 A 12/1992 Nielsen
5,277,976 A 1/1994 Hogle
5,332,426 A 7/1994 Tang
5,974,631 A 11/1999 Leifeld
6,233,787 B1 5/2001 Eriksen
6,607,624 B2 * 8/2003 Berrigan ..... D01D 5/0985 156/167
7,491,354 B2 * 2/2009 Andersen ..... B07B 1/10 264/115
7,627,933 B2 12/2009 Drapela
7,690,903 B2 * 4/2010 Norgaard ..... D04H 1/425 19/296
9,422,653 B2 * 8/2016 Wu ..... D04H 1/413
2005/0098910 A1 * 5/2005 Andersen ..... B07B 1/10 264/39
2007/0124894 A1 6/2007 Drapela
2008/0026661 A1 * 1/2008 Fox ..... B01D 39/163 442/344
2008/0038976 A1 * 2/2008 Berrigan ..... D04H 3/00 442/327
2008/0241301 A1 * 10/2008 Norgaard ..... D04H 1/425 425/145
2010/0209306 A1 * 8/2010 Kunze ..... D04H 1/4218 422/122
2010/0209308 A1 * 8/2010 Kunze ..... C04B 30/02 422/179
2010/0283176 A1 * 11/2010 Eriksen ..... D01G 25/00 264/175
2011/0247839 A1 * 10/2011 Lalouch ..... A62C 2/06 169/45
2011/0248420 A1 * 10/2011 Cordts ..... D04H 1/4209 264/115
2012/0231692 A1 * 9/2012 Peyras-Carratte ..... A47L 13/16 442/411
2013/0108831 A1 * 5/2013 Wu ..... D04H 1/541 428/138
2013/0251839 A1 * 9/2013 Schwarz ..... B29C 47/0009 425/329
2014/0331456 A1 * 11/2014 Wu ..... D04H 1/413 19/305
2015/0021805 A1 * 1/2015 Henderson ..... D04H 1/44 264/103

FOREIGN PATENT DOCUMENTS

KR 10-1079080 11/2011
WO WO 96-17986 6/1996
WO WO 9936623 A1 7/1999
WO WO 03/016605 A1 2/2003
WO WO 2005/003421 A1 1/2005
WO WO 2005-106091 11/2005
WO WO 2011/049927 A2 4/2011
WO WO 2011/133396 10/2011
WO WO 2012-006300 1/2012
WO WO 2013-101615 7/2013

OTHER PUBLICATIONS

International Search Report for PCT International Application No. PCT/US2012/071177 mailed on Apr. 29, 2013, 5 pages.

* cited by examiner

APPARATUS AND METHODS FOR PRODUCING NONWOVEN FIBROUS WEBS

CROSS REFERENCE TO RELATED APPLICATIONS

This application is a national stage filing under 35 U.S.C. 371 of PCT/US2012/071177, filed Dec. 21, 2012, which claims priority to US Provisional Application No. 61/581960, filed Dec. 30, 2011, the disclosure of which is incorporated by reference in its/their entirety herein.

TECHNICAL FIELD

The present disclosure relates to apparatus and methods useful for producing nonwoven fibrous webs, and more particularly, for air-laying nonwoven fibrous webs.

BACKGROUND

Various methods are known for producing nonwoven fibrous webs from a source of pre-formed bulk fibers. Such pre-formed bulk fibers typically undergo a considerable degree of entanglement, inter-fiber adhesion, agglomeration, or "matting" after formation or during storage prior to use in forming a nonwoven web. One particularly useful method of forming a web from a source of pre-formed bulk fibers involves air-laying, which generally involves providing the pre-formed fibers in a well-dispersed state in air, then collecting the well-dispersed fibers on a collector surface as the fibers settle through the air under the force of gravity. A number of apparatus and methods have been disclosed for air-laying nonwoven fibrous webs using pre-formed bulk fibers, for example, U.S. Pat. Nos. 6,233,787; 7,491,354; 7,627,933; and 7,690,903; and U.S. Pat. App. Pub. No. 2010/0283176 A1.

SUMMARY

In one aspect, the disclosure describes an apparatus a fiber opening chamber having an open upper end and a lower end, at least one fiber inlet for introducing a multiplicity of fibers into the opening chamber, a first multiplicity of rollers positioned within the opening chamber wherein each roller has a multiplicity of projections extending outwardly from a circumferential surface surrounding a center axis of rotation, at least one gas emission nozzle positioned substantially below the first multiplicity of rollers to direct a gas stream generally towards the open upper end of the opening chamber, and a forming chamber having an upper end and a lower end, wherein the upper end of the forming chamber is in flow communication with the upper end of the opening chamber, and the lower end of the forming chamber is substantially open and positioned above a collector having a collector surface.

In some exemplary embodiments, the apparatus includes a stationary screen positioned within the forming chamber above the collector surface. In further exemplary embodiments, the apparatus further includes a stationary screen positioned within the opening chamber under the first multiplicity of rollers. In certain exemplary embodiments of any of the foregoing, the at least one gas emission nozzle is a multiplicity of gas emission nozzles.

In additional exemplary embodiments of any of the foregoing, each of the first multiplicity of rollers is aligned in a horizontal plane extending through the center axis of rotation of each of the first multiplicity of rollers. In certain such exemplary embodiments, the apparatus further includes a second multiplicity of rollers positioned within the opening chamber above the first multiplicity of rollers, each of the second multiplicity of rollers having a center axis of rotation, a circumferential surface, and a multiplicity of projections extending outwardly from the circumferential surface. In some such exemplary embodiments, each of the second multiplicity of rollers is aligned in a horizontal plane extending through the center axis of rotation of each of the second multiplicity of rollers. In further such exemplary embodiments, each of the second multiplicity of rollers rotates in a direction which opposite to a direction of rotation for each adjacent roller in the horizontal plane extending through each center axis of rotation of the second multiplicity of rollers.

In additional exemplary embodiments of the foregoing, the center axis of rotation for one of each of the first multiplicity of rollers is vertically aligned with the center axis of rotation for a corresponding roller selected from the second multiplicity of rollers in a plane extending through the center axis of rotation for the one of the first multiplicity of rollers and the corresponding roller selected from the second multiplicity of rollers. In certain such exemplary embodiments, each one of the first multiplicity of rollers rotates in a direction which is opposite to a direction of rotation for each adjacent roller in the horizontal plane extending through the center axis of rotation of each of the first multiplicity of rollers, and further wherein each of the first multiplicity of rollers rotates in a direction which is opposite to a direction of rotation for each corresponding roller selected from the second multiplicity of rollers. Optionally, in such exemplary embodiments, the fiber inlet is positioned above the collector surface.

In additional exemplary embodiments of the foregoing, each of the second multiplicity of rollers rotates in a direction which is the same as a direction of rotation for each adjacent roller in the horizontal plane extending through each center axis of rotation of the second multiplicity of rollers. In certain such exemplary embodiments, the center axis of rotation for one of each of the first multiplicity of rollers is vertically aligned with the center axis of rotation for a corresponding roller selected from the second multiplicity of rollers in a plane extending through the center axis of rotation for the one of the first multiplicity of rollers and the corresponding roller selected from the second multiplicity of rollers, wherein each one of the first multiplicity of rollers rotates in a direction which is opposite to a direction of rotation for each adjacent roller in the horizontal plane extending through the center axis of rotation of each of the first multiplicity of roller. Optionally, in such exemplary embodiments, the fiber inlet is positioned below the first multiplicity of rollers.

In yet further exemplary embodiments of the foregoing, each projection has a length, and at least a portion of at least one projection of each of the first multiplicity of rollers lengthwise overlaps with at least a portion of at least one projection of one of the second multiplicity of rollers. In certain such exemplary embodiments, the lengthwise overlap corresponds to at least 90% of the length of at least one of the overlapping projections.

In additional exemplary embodiments of the foregoing, at least a portion of one projection of each of the second multiplicity of rollers lengthwise overlaps with at least a portion of one projection of an adjacent roller of the second multiplicity of rollers. In certain such exemplary embodiments, the lengthwise overlap corresponds to at least 90% of the length of at least one of the overlapping projections.

In further exemplary embodiments of the foregoing, at least a portion of at least one projection of each of the first multiplicity of rollers lengthwise overlaps with at least a portion of at least one projection of an adjacent roller of the first multiplicity of rollers. In certain such exemplary embodiments, the lengthwise overlap corresponds to at least 90% of the length of at least one of the overlapping projections.

In other exemplary embodiments of any of the foregoing, the at least one fiber inlet includes an endless belt for introducing the multiplicity of fibers into the lower end of the opening chamber. In certain such exemplary embodiments, the at least one fiber inlet includes a compression roller for applying a compressive force to the multiplicity of fibers on the endless belt before introducing the multiplicity of fibers into the lower end of the opening chamber. In some particular embodiments of any of the foregoing, the collector includes at least one of a stationary screen, a moving screen, a moving continuous perforated belt, or a rotating perforated drum.

In another aspect, the disclosure describes a method for making a nonwoven fibrous web including providing an apparatus according to any of the foregoing embodiments, introducing a multiplicity of fibers into the opening chamber, dispersing the multiplicity of fibers as discrete, substantially non-agglomerated fibers in a gas phase, transporting a population of the discrete, substantially non-agglomerated fibers to the lower end of the forming chamber, and collecting the population of discrete, substantially non-agglomerated fibers as a nonwoven fibrous web on a collector surface.

In further exemplary embodiments of any of the foregoing methods, the method further includes introducing a multiplicity of particulates into the forming chamber, mixing the multiplicity of discrete, substantially non-agglomerated fibers with the multiplicity of particulates within the forming chamber to form a mixture of the discrete, substantially non-agglomerated fibers and the particulates before collecting the mixture as a nonwoven fibrous web on the collector surface, and securing at least a portion of the particulates to the nonwoven fibrous web.

In certain such exemplary embodiments of methods including particulates, securing the particulates to the nonwoven fibrous web comprises at least one of thermal bonding, autogenous bonding, adhesive bonding, powdered binder binding, hydroentangling, needle punching, calendering, or a combination thereof. In some such exemplary embodiments including particulates, a liquid is introduced into the forming chamber to wet at least a portion of the discrete fibers, whereby at least a portion of the particulates adhere to the wetted portion of the discrete fibers in the forming chamber. In some such exemplary embodiments, the multiplicity of particulates is introduced into the forming chamber at the upper end, at the lower end, between the upper end and the lower end, or a combination thereof.

In some exemplary embodiments of the foregoing method, the method further includes bonding at least a portion of the multiplicity of fibers together without the use of an adhesive prior to removal of the web from the collector surface. In certain exemplary embodiments, the method further includes bonding together at least a portion of the population of discrete, substantially non-agglomerated fibers without the use of an adhesive prior to removal of the nonwoven fibrous web from the collector surface.

In additional exemplary embodiments of any of the foregoing methods, more than 0% and less than 10% wt. of the nonwoven fibrous web includes multi-component fibers further comprising at least a first region having a first melting temperature and a second region having a second melting temperature, wherein the first melting temperature is less than the second melting temperature, and wherein securing the particulates to the nonwoven fibrous web comprises heating the multi-component fibers to a temperature of at least the first melting temperature and less than the second melting temperature, whereby at least a portion of the particulates are secured to the nonwoven fibrous web by bonding to the at least first region of at least a portion of the multi-component fibers, and at least a portion of the discrete fibers are bonded together at a multiplicity of intersection points with the first region of the multi-component fibers.

In additional exemplary embodiments of any of the foregoing methods, the multiplicity of discrete, substantially non-agglomerated fibers includes a first population of monocomponent discrete thermoplastic fibers having a first melting temperature, and a second population of monocomponent discrete fibers having a second melting temperature greater than the first melting temperature; wherein securing the particulates to the nonwoven fibrous web comprises heating the first population of monocomponent discrete thermoplastic fibers to a temperature of at least the first melting temperature and less than the second melting temperature, whereby at least a portion of the particulates are bonded to at least a portion of the first population of monocomponent discrete fibers, and further wherein at least a portion of the first population of monocomponent discrete fibers is bonded to at least a portion of the second population of monocomponent discrete fibers.

In additional exemplary embodiments of any of the foregoing methods, the method further includes applying a fibrous cover layer overlaying the nonwoven fibrous web, wherein the fibrous cover layer is formed by air-laying, wet-laying, carding, melt blowing, melt spinning, electrospinning, plexifilament formation, gas jet fibrillation, fiber splitting, or a combination thereof. In certain such exemplary embodiments, the fibrous cover layer includes a population of sub-micrometer fibers having a median fiber diameter of less than 1 micrometer (μm) formed by melt blowing, melt spinning, electrospinning, plexifilament formation, gas jet fibrillation, fiber splitting, or a combination thereof.

In any of the foregoing methods, the population of the discrete, substantially non-agglomerated fibers is transported generally upward through the opening chamber, and generally downward through the forming chamber.

The exemplary apparatus and methods of the present disclosure, in some exemplary embodiments, advantageously provide an integrated process for fiber opening and air-laid web formation, even for highly matted or clumped (e.g. agglomerated) fiber sources (e.g. natural fiber sources). The exemplary apparatus and methods, in some exemplary embodiments, further advantageously permits a higher degree of control over the extent of fiber recirculation through the opening chamber, which coupled with the continuous elutriation of opened (i.e. non-agglomerated, discrete fibers) fibers out of the opening chamber and into the forming chamber, reduces the potential for overopening of the fibers, which can undesirably lead to excessive fiber loss, damage to the fibers, and/or formation of nonwoven fibrous webs which lack adequate integrity for subsequent handling or processing.

Various aspects and advantages of exemplary embodiments of the disclosure have been summarized. The above Summary is not intended to describe each illustrated embodiment or every implementation of the present invention. The Drawings and the Detailed Description that follow more particularly exemplify certain preferred embodiments using the principles disclosed herein.

BRIEF DESCRIPTION OF THE DRAWINGS

Exemplary embodiments of the present disclosure are further described with reference to the appended drawings, wherein.

Figure 1A:
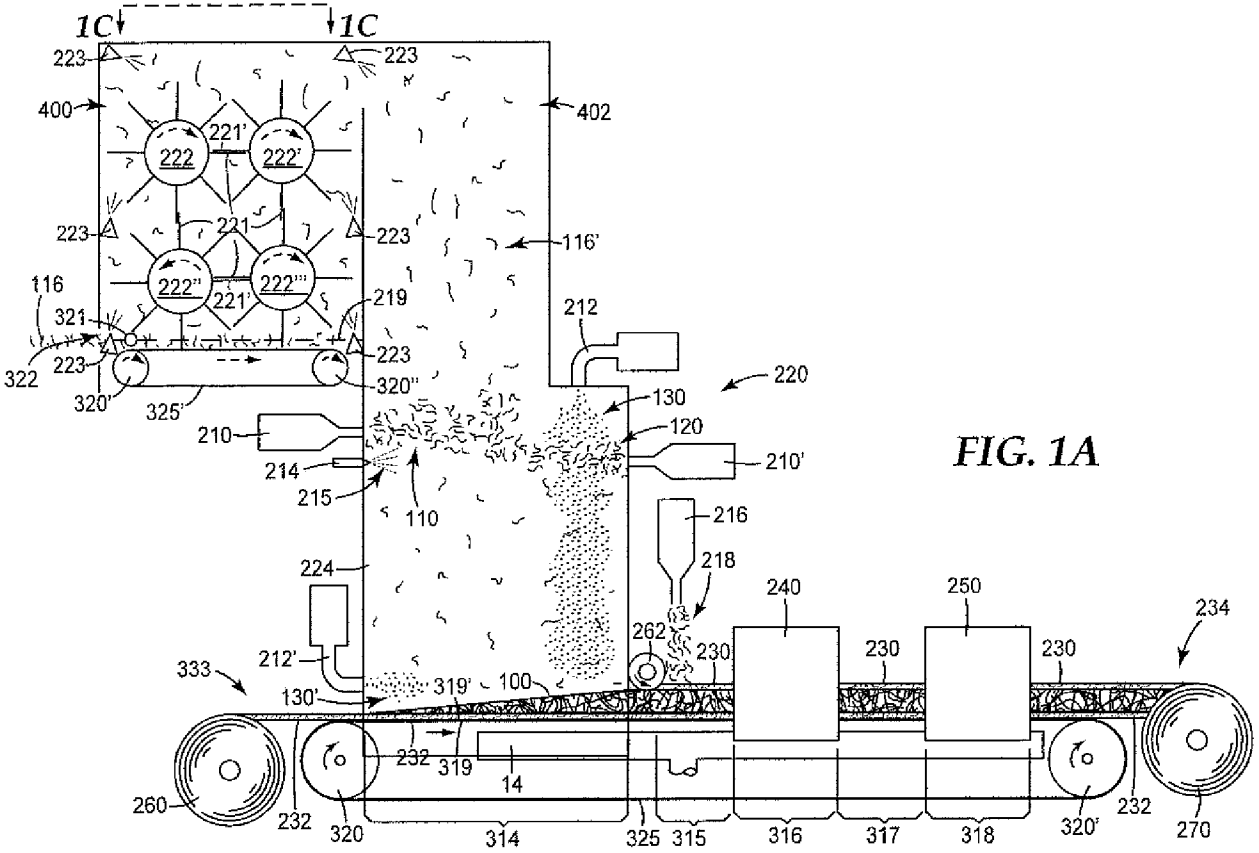
FIG. 1A is a side view showing an exemplary apparatus and process useful in forming air-laid nonwoven fibrous webs according to various exemplary embodiments of the present disclosure.

While the above-identified drawings, which may not be drawn to scale, set forth various embodiments of the present disclosure, other embodiments are also contemplated, as noted in the Detailed Description. In all cases, this disclosure describes the presently disclosed invention by way of representation of exemplary embodiments and not by express limitations. It should be understood that numerous other modifications and embodiments can be devised by those skilled in the art, which fall within the scope and spirit of this invention.

DETAILED DESCRIPTION

As used in this specification and the appended embodiments, the singular forms "a", "an", and "the" include plural referents unless the content clearly dictates otherwise. Thus, for example, reference to fine fibers containing "a compound" includes a mixture of two or more compounds. As used in this specification and the appended embodiments, the term "or" is generally employed in its sense including "and/or" unless the content clearly dictates otherwise.

As used in this specification, the recitation of numerical ranges by endpoints includes all numbers subsumed within that range (e.g. 1 to 5 includes 1, 1.5, 2, 2.75, 3, 3.8, 4, and 5).

Unless otherwise indicated, all numbers expressing quantities or ingredients, measurement of properties and so forth used in the specification and embodiments are to be understood as being modified in all instances by the term "about." Accordingly, unless indicated to the contrary, the numerical parameters set forth in the foregoing specification and attached listing of embodiments can vary depending upon the desired properties sought to be obtained by those skilled in the art utilizing the teachings of the present disclosure. At the very least, and not as an attempt to limit the application of the doctrine of equivalents to the scope of the claimed embodiments, each numerical parameter should at least be construed in light of the number of reported significant digits and by applying ordinary rounding techniques.

For the following Glossary of defined terms, these definitions shall be applied for the entire application, unless a different definition is provided in the claims or elsewhere in the specification.

Glossary

"Air-laying" is a process by which a nonwoven fibrous web layer can be formed. In the air-laying process, bundles of small fibers having typical lengths ranging from about 3 to about 52 millimeters (mm) are separated and entrained in a gas (e.g. air, nitrogen, an inert gas, or the like) and then deposited onto a forming screen, usually with the assistance of a vacuum supply. The randomly oriented fibers may then be bonded to one another using, for example, thermal point bonding, autogenous bonding, hot air bonding, needle punching, calendering, a spray adhesive, and the like. An exemplary air-laying process is taught in, for example, U.S. Pat. No. 4,640,810 (Laursen et al.).

"Lengthwise overlap" with particular reference to a first projection extending from a first roller relative to a second projection extending from a second, adjacent roller (either horizontally or vertically adjacent) refers to the percentage of the entire length of the first projection which spatially overlaps or "engages" with the second roller.

"Opening" refers to the process of converting a clump of highly agglomerated fibers into substantially non-agglomerated, discrete fibers.

"Substantially non-agglomerated" with particular reference to a population of fibers refers to a population of fibers wherein at least about 80%, more preferably 90%, 95%, 98%, 99%, or even at most 100% by weight of the fibers comprises individual discrete fibers not adhered or otherwise bonded to other fibers.

"Nonwoven fibrous web" means an article or sheet having a structure of individual fibers or fibers, which are interlaid, but not in an identifiable manner as in a knitted fabric. Nonwoven fabrics or webs have been formed from many processes such as for example, meltblowing processes, air-laying processes, and bonded carded web processes.

"Cohesive nonwoven fibrous web" means a fibrous web characterized by entanglement or bonding of the fibers sufficient to form a self-supporting web.

"Self-supporting" means a web having sufficient coherency and strength so as to be drapable and handleable without substantial tearing or rupture.

"Non-hollow" with particular reference to projections extending from a major surface of a nonwoven fibrous web means that the projections do not contain an internal cavity or void region other than the microscopic voids (i.e. void volume) between randomly oriented discrete fibers.

"Randomly oriented" with particular reference to a population of fibers means that the fiber bodies are not substantially aligned in a single direction.

"Wet-laying" is a process by which a nonwoven fibrous web layer can be formed. In the wet-laying process, bundles of small fibers having typical lengths ranging from about 3 to about 52 millimeters (mm) are separated and entrained in a liquid supply and then deposited onto a forming screen, usually with the assistance of a vacuum supply. Water is typically the preferred liquid. The randomly deposited fibers may by further entangled (e.g. hydro-entangled), or may be bonded to one another using, for example, thermal point bonding, autogenous bonding, hot air bonding, ultrasonic bonding, needle punching, calendering, application of a spray adhesive, and the like. An exemplary wet-laying and bonding process is taught in, for example, U.S. Pat. No. 5,167,765 (Nielsen et al.). Exemplary bonding processes are also disclosed in, for example, U.S. Pat. App. Pub. No. 2008/0038976 A1 (Berrigan et al.).

To "co-form" or a "co-forming process" means a process in which at least one fiber layer is formed substantially simultaneously with or in-line with formation of at least one different fiber layer. Webs produced by a co-forming process are generally referred to as "co-formed webs."

"Particulate loading" or a "particle loading process" means a process in which particulates are added to a fiber stream or web while it is forming. Exemplary particulate loading processes are taught in, for example, U.S. Pat. No. 4,818,464 (Lau) and U.S. Pat. No. 4,100,324 (Anderson et al.).

"Particulate" and "particle" are used substantially interchangeably. Generally, a particulate or particle means a small distinct piece or individual part of a material in finely divided form. However, a particulate may also include a collection of individual particles associated or clustered together in finely divided form. Thus, individual particulates used in certain exemplary embodiments of the present disclosure may clump, physically intermesh, electro-statically associate, or otherwise associate to form particulates. In certain instances, particulates in the form of agglomerates of individual particulates may be intentionally formed such as those described in U.S. Pat. No. 5,332,426 (Tang et al.).

"Particulate-loaded media" or "particulate-loaded nonwoven fibrous web" means a nonwoven web having an open-structured, entangled mass of discrete fibers, containing particulates enmeshed within or bonded to the fibers, the particulates being chemically active.

"Enmeshed" means that particulates are dispersed and physically held in the fibers of the web. Generally, there is point and line contact along the fibers and the particulates so that nearly the full surface area of the particulates is available for interaction with a fluid.

"Microfibers" means a population of fibers having a population median diameter of at least one micrometer (μm).

"Coarse microfibers" means a population of microfibers having a population median diameter of at least 10 μm.

"Fine microfibers" means a population of microfibers having a population median diameter of less than 10 μm.

"Ultrafine microfibers" means a population of microfibers having a population median diameter of 2 μm or less.

"Sub-micrometer fibers" means a population of fibers having a population median diameter of less than 1 μm.

"Continuous oriented microfibers" means essentially continuous fibers issuing from a die and traveling through a processing station in which the fibers are permanently drawn and at least portions of the polymer molecules within the fibers are permanently oriented into alignment with the longitudinal axis of the fibers ("oriented" as used with respect to a particular fiber means that at least portions of the polymer molecules of the fiber are aligned along the longitudinal axis of the fiber).

"Separately prepared microfibers" means a stream of microfibers produced from a microfiber-forming apparatus (e.g., a die) positioned such that the microfiber stream is initially spatially separate (e.g., over a distance of about 1 inch (25 mm) or more from, but will merge in flight and disperse into, a stream of larger size microfibers.

"Web basis weight" is calculated from the weight of a 10 cm×10 cm web sample, and is usually expressed in grams per square meter (gsm).

"Web thickness" is measured on a 10 cm×10 cm web sample using a thickness testing gauge having a tester foot with dimensions of 5 cm×12.5 cm at an applied pressure of 150 Pa.

"Bulk density" is the mass per unit volume of the bulk polymer or polymer blend that makes up the web, taken from the literature.

"Effective Fiber Diameter" or "EFD" is the apparent diameter of the fibers in a fiber web based on an air permeation test in which air at 1 atmosphere and room temperature is passed through a web sample at a specified thickness and face velocity (typically 5.3 cm/sec), and the corresponding pressure drop is measured. Based on the measured pressure drop, the Effective Fiber Diameter is calculated as set forth in Davies, C.N., *The Separation of Airborne Dust and Particulates*, Institution of Mechanical Engineers, London Proceedings, 1B (1952).

"Molecularly same polymer" means polymers that have essentially the same repeating molecular unit, but which may differ in molecular weight, method of manufacture, commercial form, and the like.

"Layer" means a single stratum formed between two major surfaces. A layer may exist internally within a single web, e.g., a single stratum formed with multiple strata in a single web having first and second major surfaces defining the thickness of the web. A layer may also exist in a composite article comprising multiple webs, e.g., a single stratum in a first web having first and second major surfaces defining the thickness of the web, when that web is overlaid or underlaid by a second web having first and second major surfaces defining the thickness of the second web, in which case each of the first and second webs forms at least one layer. In addition, layers may simultaneously exist within a single web and between that web and one or more other webs, each web forming a layer.

"Adjoining" with reference to a particular first layer means joined with or attached to another, second layer, in a position wherein the first and second layers are either next to (i.e., adjacent to) and directly contacting each other, or contiguous with each other but not in direct contact (i.e., there are one or more additional layers intervening between the first and second layers).

"Particulate density gradient," "sorbent density gradient," and "fiber population density gradient" mean that the amount of particulate, sorbent or fibrous material within a particular fiber population (e.g., the number, weight or volume of a given material per unit volume over a defined area of the web) need not be uniform throughout the nonwoven fibrous web, and that it can vary to provide more material in certain areas of the web and less in other areas.

"Die" means a processing assembly for use in polymer melt processing and fiber extrusion processes, including but not limited to meltblowing and spun-bonding.

"Meltblowing" and "meltblown process" means a method for forming a nonwoven fibrous web by extruding a molten fiber-forming material through a plurality of orifices in a die to form fibers while contacting the fibers with air or other attenuating fluid to attenuate the fibers into fibers, and thereafter collecting the attenuated fibers. An exemplary meltblowing process is taught in, for example, U.S. Pat. No. 6,607,624 (Berrigan et al.).

"Meltblown fibers" means fibers prepared by a meltblowing or meltblown process.

"Spun-bonding" and "spunbond process" mean a method for forming a nonwoven fibrous web by extruding molten fiber-forming material as continuous or semi-continuous fibers from a plurality of fine capillaries of a spinneret, and thereafter collecting the attenuated fibers. An exemplary spun-bonding process is disclosed in, for example, U.S. Pat. No. 3,802,817 (Matsuki et al.).

"Spunbond fibers" and "spun-bonded fibers" mean fibers made using spun-bonding or a spunbond process. Such fibers are generally continuous fibers and are entangled or point bonded sufficiently to form a cohesive nonwoven fibrous web such that it is usually not possible to remove one complete spunbond fiber from a mass of such fibers. The fibers may also have shapes such as those described, for example, in U.S. Pat. No. 5,277,976 (Hogle et al.), which describes fibers with unconventional shapes.

"Carding" and "carding process" mean a method of forming a nonwoven fibrous web webs by processing staple fibers through a combing or carding unit, which separates or breaks apart and aligns the staple fibers in the machine direction to form a generally machine direction oriented fibrous nonwoven web. An exemplary carding process is taught in, for example, U.S. Pat. No. 5,114,787 (Chaplin et al.).

"Bonded carded web" refers to nonwoven fibrous web formed by a carding process wherein at least a portion of the fibers are bonded together by methods that include for example, thermal point bonding, autogenous bonding, hot air bonding, ultrasonic bonding, needle punching, calendering, application of a spray adhesive, and the like.

"Autogenous bonding" means bonding between fibers at an elevated temperature as obtained in an oven or with a through-air bonder without application of solid contact pressure such as in point-bonding or calendering.

"Calendering" means a process of passing a nonwoven fibrous web through rollers with application of pressure to obtain a compressed and bonded fibrous nonwoven web. The rollers may optionally be heated.

"Densification" means a process whereby fibers which have been deposited either directly or indirectly onto a filter winding arbor or mandrel are compressed, either before or after the deposition, and made to form an area, generally or locally, of lower porosity, whether by design or as an artifact of some process of handling the forming or formed filter. Densification also includes the process of calendering webs.

"Fluid treatment unit", "fluid filtration article", or "fluid filtration system" means an article containing a fluid filtration medium, such as a porous nonwoven fibrous web. These articles typically include a filter housing for a fluid filtration medium and an outlet to pass treated fluid away from the filter housing in an appropriate manner. The term "fluid filtration system" also includes any related method of separating raw fluid, such as untreated gas or liquid, from treated fluid.

"Void volume" means a percentage or fractional value for the unfilled space within a porous or fibrous body, such as a web or filter, which may be calculated by measuring the weight and volume of a web or filter, then comparing the weight to the theoretical weight of a solid mass of the same constituent material of that same volume.

"Porosity" means a measure of void spaces in a material. Size, frequency, number, and/or interconnectivity of pores and voids contribute the porosity of a material.

Various exemplary embodiments of the disclosure will now be described with particular reference to the Drawings. Exemplary embodiments of the invention may take on various modifications and alterations without departing from the spirit and scope of the disclosure. Accordingly, it is to be understood that the embodiments of the invention are not to be limited to the following described exemplary embodiments, but is to be controlled by the limitations set forth in the claims and any equivalents thereof A. Apparatus for Making Air-Laid Nonwoven Fibrous Webs Referring now to FIG. 1A, an exemplary apparatus 220 which may be configured to practice various processes for making an air-laid nonwoven fibrous web 234 is shown.

1. Apparatus for Opening Clumped Fibers and Forming an Air-Laid Web

Thus, exemplary embodiments of the disclosure provide an apparatus 220 comprising a fiber opening chamber 400 having an open upper end and a lower end, at least one fiber inlet 322 for introducing a plurality of fibers 116 into the opening chamber 400, a first plurality of rollers 222"-222'" positioned within the opening chamber wherein each roller has a plurality of projections 221-221' extending outwardly from a circumferential surface surrounding a center axis of rotation, at least one gas emission nozzle 223 (e.g. an "air knife") positioned substantially below the first plurality of rollers 222"-222'" to direct a gas stream generally towards the open upper end of the opening chamber 400, and a forming chamber 402 having an upper end and a lower end, wherein the upper end of the forming chamber is in flow communication with the upper end of the opening chamber 400, and the lower end of the forming chamber 402 is substantially open and positioned above a collector 232 having a collector surface 319'.

In certain exemplary embodiments of any of the foregoing, the at least one gas emission nozzle comprises a plurality of gas emission nozzles 223, some of which may be positioned above the first plurality of rollers 222"-222" as shown in FIG. 1A. The gas emission nozzles 223 may be advantageously used to introduced air at an upward angle (e.g. between 20-80° from horizontal) into the opening chamber 400 to permit opened, non-agglomerated, discrete fibers 116' to pass out of the top of the opening chamber 400 and into the top of the forming chamber 402.

Figure 1B:
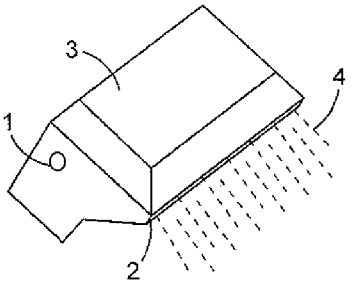
FIG. 1B is a detailed perspective view showing of an exemplary gas emission nozzle useful in practicing various embodiments of the exemplary apparatus and process of FIG. 1A.

FIG. 1B is a detailed perspective view showing an exemplary gas emission nozzle 223 comprising a gas inlet 1, a body portion 3, and a gas exit 2 for controllably directing a gas stream 4 emitted from the gas emission nozzle 223. Although a rectangular slot or slit configuration is shown for gas exit 2 in FIG. 1B, other geometries (e.g. circular or polygonal) may be advantageously selected for gas exit 2. Suitable gas emission nozzles 223 having rectangular, circular or polygonal gas exits 2 are commercially available, for example, from Spraying Systems Co. (Wheaton, Ill.).

Virtually any gas may be advantageously used, although nontoxic gases such as air, or inert gases such as nitrogen, helium, argon, and the like are currently preferred. Preferably, the gas is introduced to the gas inlet 1 at a pressure from about 1 PSIG (about 6,895 Pa) to no more than about 200 PSIG (about 1.379 MPa), more preferably at least about 5, 10, 15, 20, 25 or even 30 PSIG (at least about 34,475; 68,950; 103,425; 137,900; or even 206,850 Pa); even more preferably, at most 100, 90, 80, 70, 60 or even 50 PSIG (at most about 0.690; 0.6205; 0.552; 0.483; 0.414; or even 0.345 MPa).

In general, the higher the gas pressure, the more likely non-agglomerated, discrete fibers 116' will be elutriated out of the top of opening chamber 400. Furthermore, the lower the position of the gas emission nozzles 223 in the opening chamber 400, the more likely it is to recirculate unopened fiber clamps which pass through the first plurality of rollers 222"-222'". Additionally, the further the gas emission nozzle(s) 223 are positioned from the projections 221-221' of the first plurality of rollers 222"-222'", the more likely that unopened fiber clumps will be recirculated through the first plurality of rollers 222"-222'" due to the action of the gas stream emitted from the gas emission nozzle(s) 223.

Returning to FIG. 1A, in additional exemplary embodiments of any of the foregoing, each of the first plurality of rollers 222"-222'" is shown aligned in a horizontal plane extending through the center axis of rotation of each of the first plurality of rollers 222"-222'", such that the projections 221' lengthwise overlap in a horizontal plane extending through the center axis of rotation of each of the first plurality of rollers 222"-222'".

In the foregoing exemplary embodiments, the apparatus 220 may advantageously further include a second plurality of rollers 222-222' positioned within the opening chamber 400 above the first plurality of rollers 222"-222'", each of the second plurality of rollers 222-222' having a center axis of rotation, a circumferential surface, and a plurality of projections 221-221' extending outwardly from the circumferential surface.

In some such exemplary embodiments illustrated by FIG. 1A, each of the second plurality of rollers 222 and 222' is aligned in a horizontal plane extending through the center axis of rotation of each of the second plurality of rollers 222-222'. In FIG. 1A, each of the second plurality of rollers 222-222' is shown aligned in a horizontal plane extending through the center axis of rotation of each of the second plurality of rollers 222 and 222', such that the projections 221-221' of each horizontally adjacent roller lengthwise overlaps in a horizontal plane extending through the center axis of rotation of each of the first plurality of rollers 222"-222'".

Figure 1C:
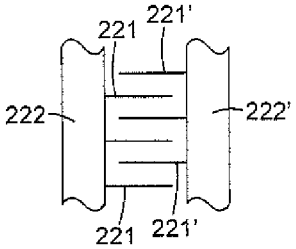
FIG. 1C is a detailed cross-sectional top view showing details of a portion of the exemplary apparatus and process of FIG. 1A according to various exemplary embodiments of the present disclosure.

FIG. 1C provides a detailed cross-sectional top view showing the horizontal lengthwise overlap (i.e. the horizontal engagement) of projections 221 extending from the circumferential surface of a first roller 222 of the second plurality of rollers 222-222', with projections 221' extending from the circumferential surface of a second roller 222' of the second plurality of rollers 222-222' positioned horizontally adjacent to the first roller 222, according to various exemplary embodiments of the present disclosure.

In further such exemplary embodiments, each of the second plurality of rollers 222 and 222' rotates in a direction which is opposite to a direction of rotation for each adjacent roller 222' and 222 in the horizontal plane extending through each center axis of rotation of the second plurality of rollers 222-222', as shown by the directional arrows in FIG. 1A.

In additional exemplary embodiments illustrated in FIG. 1A, the center axis of rotation for one of each of the first plurality of rollers 222"-222'" is vertically aligned with the center axis of rotation for a corresponding roller 222 or 222' selected from the second plurality of rollers 222-222' in a plane extending through the center axis of rotation for the one of the first plurality of rollers 222"-222'" and the corresponding roller 222 or 222' selected from the second plurality of rollers 222-222'.

In certain such exemplary embodiments, each one of the first plurality of rollers 222" and 222'" rotates in a direction (shown by the directional arrows in FIG. 1A) which is opposite to a direction of rotation (shown by the directional arrows in FIG. 1A) for each adjacent roller 222'" or 222" in the horizontal plane extending through the center axis of rotation of each of the first plurality of rollers 222"-222'". In some particular exemplary embodiments, the first plurality of rollers 222"-222'" rotates in a direction which is opposite to a direction of rotation for each corresponding (vertically adjacent) roller selected from the second plurality of rollers 222-222'. Optionally, in such exemplary embodiments, the fiber inlet 322 is positioned above (but preferably not directly above) the collector surface 319', for example, as shown in FIG. 1A.

In additional exemplary embodiments of the foregoing illustrated by FIG. 1A, each of the second plurality of rollers 222-222' rotates in a direction (shown by the directional arrows in FIG. 1A) which is the same as a direction of rotation for each adjacent roller 222' or 222 in the horizontal plane extending through each center axis of rotation of the second plurality of rollers 222-222'.

In certain such exemplary embodiments, the center axis of rotation for one of each of the first plurality of rollers is vertically aligned with the center axis of rotation for a corresponding roller selected from the second plurality of rollers in a plane extending through the center axis of rotation for the one of the first plurality of rollers and the corresponding roller selected from the second plurality of rollers, wherein each one of the first plurality of rollers rotates in a direction which is opposite to a direction of rotation for each adjacent roller in the horizontal plane extending through the center axis of rotation of each of the first plurality of roller. Optionally, in such exemplary embodiments, the fiber inlet 322 is positioned below the first plurality of rollers.

Figure 2:
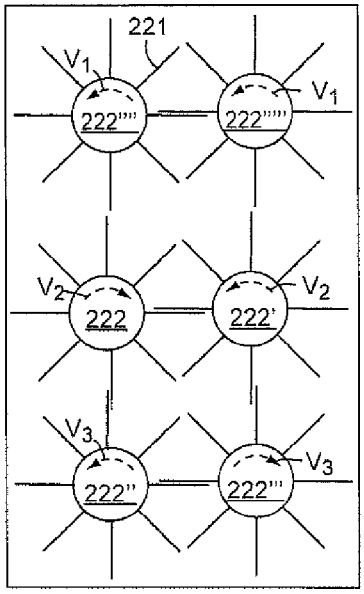
FIG. 2 is a detailed cross-sectional side view showing another exemplary embodiment of an apparatus and process useful in forming air-laid nonwoven fibrous webs according to exemplary embodiments of the present disclosure.

As illustrated by FIG. 2, in further exemplary embodiments of the foregoing, each projection 221 has a length, and at least a portion of at least one projection 221 of each of the first plurality of rollers 222"-222'" vertically lengthwise overlaps with at least a portion of at least one projection 221 of one of the vertically adjacent rollers 222 or 222' of the second plurality of rollers 222-222', as illustrated by rollers 222 and 222", and rollers 222' and 222'" in FIG. 2. In certain such exemplary embodiments, the vertical lengthwise overlap corresponds to at least 90% of the length of at least one of the vertically overlapping projections 221.

Preferably, each of the first plurality of rollers 222"-222'" is rotated at a rotational frequency from about 5-50 Hz; more preferably 10-40 Hz, even more preferably about 15-30 Hz or even about 20 Hz.

In additional exemplary embodiments of the foregoing shown in FIG. 2, at least a portion of one projection 221 of each of the second plurality of rollers 222 and 222' horizontally lengthwise overlaps with at least a portion of one projection 221 of a horizontally adjacent roller 222' or 222, respectively, of the second plurality of rollers. In certain such exemplary embodiments, the horizontal lengthwise overlap corresponds to at least 90% of the length of at least one of the horizontally overlapping projections.

Preferably, each of the second plurality of rollers 222-222' is rotated at a rotational frequency from about 15-50 Hz; more preferably 10-40 Hz, even more preferably about 15-30 Hz or even about 10-20 Hz.

In order to obtain a high degree of unopened fiber clump recirculation through the first plurality of rollers 222"-222'", it is preferable that each of the second plurality of rollers 222-222' is rotated at a rotational frequency greater than the rotational frequency of the corresponding vertically engaged roller selected from the first plurality of rollers 222"-222'". In some exemplary embodiments, the ratio of the rotational frequency of the second plurality of rollers 222-222' to the rotational frequency of the first plurality of rollers 222"-222'" is selected to be 0.5:1, 1:1, 2:1 or even more preferably 4:1.

In further exemplary embodiments of the foregoing shown in FIG. 2, at least a portion of at least one projection 221 of each of the first plurality of rollers 222" and 222'" horizontally lengthwise overlaps with at least a portion of at least one projection 221 of a horizontally adjacent roller 222'" or 222", respectively, of the first plurality of rollers. In certain such exemplary embodiments, the horizontal lengthwise overlap corresponds to at least 90% of the length of at least one of the horizontally overlapping projections 221.

In some alternative exemplary embodiments shown in FIG. 2, the apparatus 220 may advantageously further include an additional (e.g. third, fourth, or higher) plurality of rollers 222""-222"" positioned within the opening chamber 400 above the first plurality of rollers 222"-222'", and the second plurality of rollers 222-222', each of the additional plurality of rollers 222""-222"" having a center axis of rotation, a circumferential surface, and a plurality of projections 221 extending outwardly from the circumferential surface.

In some exemplary embodiments, at least a portion of at least one projection 221 of each of the additional plurality of rollers 222"" and 222"" horizontally lengthwise overlaps with at least a portion of at least one projection 221 of a horizontally adjacent roller 222"" or 222"", respectively, of the additional plurality of rollers 222""-222"". In certain such exemplary embodiments, the horizontal lengthwise overlap corresponds to at least 90% of the length of at least one of the horizontally overlapping projections 221.

In some particular embodiments illustrated by FIG. 2, the additional plurality of rollers 222""-222"" is positioned so as not to vertically lengthwise overlap with other rollers, for example, rollers 222 or 222'. Such positioning of the additional plurality of rollers 222""-222"" provides a roller configuration in which the first plurality of rollers 222" and 222'" work in combination with the second plurality of rollers 222 and 222' to recirculate and thus "open" the clumps of agglomerated fibers 116 to form substantially non-agglomerated, discrete fibers 116' which may be transported out of the top of the opening chamber 400 and into the top of the forming chamber 402 by the rotational action of the additional plurality of vertically disengaged rollers 222""-222"".

As shown in FIG. 1A, in certain exemplary embodiments of any of the foregoing, the at least one fiber inlet 219 may comprise an endless belt 325' driven by rollers 320'-320" for introducing the plurality of unopened fibers 116 into the lower end of the opening chamber 400. In certain such exemplary embodiments, the at least one fiber inlet 219 may optionally preferably include a compression roller 321 for applying a compressive force to the plurality of fibers 116 on the endless belt 325' before introducing the plurality of fibers 116 into the lower end of the opening chamber 400.

Figure 1D:
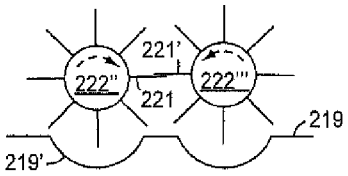
FIG. 1D is a detailed cross-sectional side view showing details of a portion of the exemplary apparatus and process of FIG. 1A according to various exemplary embodiments of the present disclosure.

In further exemplary embodiments illustrated by FIG. 1D, the apparatus 220 may further include a fiber inlet 322 comprising a stationary screen 219 positioned within the opening chamber 400 under the first plurality of rollers 222"-222'". In some exemplary embodiments, the stationary screen 219 may be bent into a curved portion 219' in conformance with the position of the lower rollers 222" and 222'", such that the floor is concentric to the radius of the projections 221-221' of rollers 222" and 222'", respectively. Typically, it is desirable to maintain a clearance of from 0.5-1" (1.27-2.54 cm) between the curved portion 219' of the stationary screen 219 and the projections 221-221'.

In some particular embodiments of any of the foregoing, the collector 319 includes at least one of a stationary screen, a moving screen, a moving continuous perforated belt, or a rotating perforated drum, as shown in FIG. 1A. In some exemplary embodiments, a vacuum source can be advantageously included below the collector 319 (not shown), in order to draw air through a perforated or porous collector, thereby improving the degree of fiber retention on the collector surface 319'.

2. Optional Apparatus for Introducing Additional Fiber Input Streams

Returning now to FIG. 1A, in further optional exemplary embodiments, one or more optional discrete fiber input streams (210, 210') may be advantageously used to add additional fibers (110-120) to the forming chamber 402, which can be mixed with the substantially non-agglomerated, discrete (i.e. "opened") fibers 116' received from the opening chamber 400, and ultimately collected to form an air-laid nonwoven fibrous web 234.

For example, as shown in FIG. 1A, a separate fiber stream 210 is shown introducing a plurality of fibers (preferably multi-component fibers) 110 into the forming chamber 402; and a separate fiber stream 210' is shown introducing a plurality of discrete filling fibers 120 (which may be natural fibers) into the forming chamber 402. However, it is to be understood that the discrete fibers need not be introduced into the chamber as separate streams, and at least a portion of the discrete fibers may advantageously be combined into a single fiber stream prior to entering the forming chamber 402. For example, prior to entering the forming chamber 402, an opener (not shown) may be included to open, comb, and/or blend the input discrete fibers, particularly if a blend of multi-component 110 and filling fibers 120 is included.

Furthermore, the positions at which the fiber streams (210, 210') are introduced into the forming chamber 402 may be advantageously varied. For example, a fiber stream may advantageously be located at the left side, top, or right side of the chamber. Furthermore, a fiber stream may advantageously be positioned to introduce at the top, or even at the middle of the forming chamber 402. However, it is presently preferred that the fiber streams be introduced above endless belt screen 224, as described further below.

3. Optional Apparatus for Introducing Particulates

Also shown entering the forming chamber 402 is one or more input streams (212, 212') of particulates (130, 130'). Although two streams of particulates (212, 212') are shown in FIG. 1A, it is to be understood that only one stream may be used, or more than two streams may be used. It is to be understood that if multiple input streams (212, 212') are used, the particulates may be the same (not shown) or different (130, 130') in each stream (212, 212'). If multiple input streams (212, 212') are used, it is presently preferred that the particulates (130, 130') comprise distinct particulate materials.

It is further understood that the particulate input stream(s) (212, 212') may be advantageously introduced at other regions of the forming chamber 402. For example, the particulates may be introduced proximate the top of the forming chamber 402 (input stream 212 introducing particulates 130), and/or in the middle of the chamber (not shown), and/or at the bottom of the forming chamber 402 (input stream 212' introducing particulates 130').

Furthermore, the positions at which the particulate input streams (212, 212') are introduced into the forming chamber 402 may be advantageously varied. For example, an input stream may advantageously be located to introduce particulates (130, 130') at the left side (212'), top (212), or right side (not shown) of the chamber. Furthermore, an input stream may advantageously be positioned to introduce particulates (130, 130') at the top (212), middle (not shown) or bottom (212') of the forming chamber 402.

In some exemplary embodiments (e.g. wherein the particulates comprise fine particulates with median size or diameter of about 1-25 micrometers, or wherein the particulates comprise low density particulates with densities less than 1 g/ml), it is presently preferred that at least one input stream (212) for particulates (130) be introduced above endless belt screen 224, as described further below.

In other exemplary embodiments (e.g. wherein the particulates comprise coarse particulates with median size or diameter of greater than about 25 micrometers, or wherein the particulates comprise high density particulates with densities greater than 1 g/ml), it is presently preferred that at least one input stream (212') for particulates (130') be introduced below endless belt screen 224, as described further below. In certain such embodiments, it is presently preferred that at least one input stream (212') for particulates (130') be introduced at the left side of the chamber.

Furthermore, in certain exemplary embodiments wherein the particulates comprise extremely fine particulates with median size or diameter of less than about 5 micrometers and density greater than 1 g/ml, it is presently preferred that at least one input stream (212') for particulates be introduced at the right side of the chamber, preferably below endless belt screen 224, as described further below.

Additionally, in some particular exemplary embodiments, an input stream (e.g. 212) may advantageously be located to introduce particulates (e.g. 130) in a manner such that the particulates 130 are distributed substantially uniformly throughout the air-laid nonwoven fibrous web 234. Alternatively, in some particular exemplary embodiments, an input stream (e.g. 212') may advantageously be located to introduce particulates (e.g. 130') in a manner such that the particulates 130 are distributed substantially at a major surface of the air-laid nonwoven fibrous web 234, for example, proximate the lower major surface of air-laid nonwoven fibrous web 234 in FIG. 1A, or proximate the upper major surface of air-laid nonwoven fibrous web 234 (not shown).

Although FIG. 1A illustrates one exemplary embodiment wherein particulates (e.g., 130') may be distributed substantially at the lower major surface of the air-laid nonwoven fibrous web 234, it is to be understood that other distributions of the particulates within the air-laid nonwoven fibrous web may be obtained, which will depend upon the location of the input stream of particulates into the forming chamber 402, and the nature (e.g., median particle size or diameter, density, etc.) of the particulates.

Thus, in one exemplary embodiment (not shown), an input stream of particulates may be advantageously located (e.g., proximate the lower right side of forming chamber 402) to introduce extremely coarse or high density particulates in a manner such that the particulates are distributed substantially at the top major surface of air-laid nonwoven fibrous web 234. Other distributions of particulates (130, 130') on or within the air-laid nonwoven fibrous web 234 are within the scope of this disclosure.

Suitable apparatus for introducing the input streams (212, 212') of particulates (130, 130') to forming chamber 402 include commercially available vibratory feeders, for example, those manufactured by K-Tron, Inc. (Pitman, N.J.). The input stream of particulates may, in some exemplary embodiments, be augmented by an air nozzle to fluidize the particulates. Suitable air nozzles are commercially available from Spraying Systems, Inc. (Wheaton, Ill.).

4. Optional Bonding Apparatus for Bonding the Fibrous Web

In some exemplary embodiments, the formed air-laid nonwoven fibrous web 234 exits the forming chamber 402 on the surface 319' of the collector 319, and proceeds to an optional heating unit 240, such as an oven, which, if multi-component fibers are included in the air-laid nonwoven fibrous web 234, is used to heat a meltable or softenable first region of the multi-component fiber. The melted or softened first region tends to migrate and collect at points of intersection of the fibers of the air-laid nonwoven fibrous web 234. Then, upon cooling, the melted first region coalesces and solidifies to create a secured, interconnected air-laid nonwoven fibrous web 234.

The optional particulates 130, if included, may, in some embodiments, be secured to the air-laid nonwoven fibrous web 234 by the melted and then coalesced first region of the multi-component fiber, or a partially melted and then coalesced first population of thermoplastic monocomponent fibers. Therefore, in two steps, first forming the web and then heating the web, a nonwoven web containing particulates 130 can be created without the need for binders or further coating steps.

In additional exemplary embodiments of any of the foregoing methods, more than 0% and less than 10% wt. of the nonwoven fibrous web includes multi-component fibers further comprising at least a first region having a first melting temperature and a second region having a second melting temperature, wherein the first melting temperature is less than the second melting temperature, and wherein securing the particulates to the nonwoven fibrous web comprises heating the multi-component fibers to a temperature of at least the first melting temperature and less than the second melting temperature, whereby at least a portion of the particulates are secured to the nonwoven fibrous web by bonding to the at least first region of at least a portion of the multi-component fibers, and at least a portion of the discrete fibers are bonded together at a plurality of intersection points with the first region of the multi-component fibers.

In additional exemplary embodiments of any of the foregoing methods, the plurality of discrete, substantially non-agglomerated fibers includes a first population of monocomponent discrete thermoplastic fibers having a first melting temperature, and a second population of monocomponent discrete fibers having a second melting temperature greater than the first melting temperature; wherein securing the particulates to the nonwoven fibrous web comprises heating the first population of monocomponent discrete thermoplastic fibers to a temperature of at least the first melting temperature and less than the second melting temperature, whereby at least a portion of the particulates are bonded to at least a portion of the first population of monocomponent discrete fibers, and further wherein at least a portion of the first population of monocomponent discrete fibers is bonded to at least a portion of the second population of monocomponent discrete fibers.

In one exemplary embodiment, the particulates 130 fall through the fibers of the air-laid nonwoven fibrous web 234 and are therefore preferentially on a lower surface of the air-laid nonwoven fibrous web 234. When the air-laid nonwoven fibrous web proceeds to the heating unit 240, the melted or softened and then coalesced first region of the multi-component fibers coated on the lower surface of the air-laid nonwoven fibrous web 234 secures the particulates 130 to the air-laid nonwoven fibrous web 234, preferably without the need for an additional binder coating.

In another exemplary embodiment, when the air-laid nonwoven fibrous web is a relatively dense web with small openings, the particulates 130 remain preferentially on a top surface 234 of the air-laid nonwoven fibrous web 234. In such an embodiment, a gradient may form of the particulates partially falling through some of the openings of the web. When the air-laid nonwoven fibrous web 234 proceeds to the heating unit 240, the melted or softened and then coalesced first region of the multi-component fibers (or partially melted thermoplastic monocomponent fibers) located on or proximate the top surface of the air-laid nonwoven fibrous web 234 secures the particulates 130 to the air-laid nonwoven fibrous web 234, preferably without the need for an additional binder coating.

In another embodiment, a liquid 215, which is preferably water or an aqueous solution, is introduced as a mist from an atomizer 214. The liquid 215 preferably wets the discrete fibers (110, 116, 120), so that the particulates (130, 130') cling to the surface of the fibers. Therefore, the particulates (130, 130') are generally dispersed throughout the thickness of the air-laid nonwoven fibrous web 234. When the air-laid nonwoven fibrous web 234 proceeds to the heating unit 240, the liquid 215 preferably evaporates while the first region of the (multi-component or thermoplastic monocomponent) discrete fibers melt or soften. The melted or softened and then coalesced first region of the multi-component (or thermoplastic monocomponent) discrete fiber secures the fibers of the air-laid nonwoven fibrous web 234 together, and additionally secures the particulates (130, 130') to the air-laid nonwoven fibrous web 234, without the need for an additional binder coating.

The mist of liquid 215 is shown wetting the fibers 110, and 116' and 120, if included, after introduction of the discrete fibers (110, 116', 120) into the forming chamber 402. However, wetting of the fibers could occur at other locations in the process, including before introduction of the discrete fibers (110, 116', 120) into the forming chamber 402. For example, liquid may be introduced at the bottom of the forming chamber 402 to wet the air-laid nonwoven fibrous web 234 while the particulates 130 are being dropped. The mist if liquid 215 could additionally or alternatively be introduced at the top of the forming chamber 402, or in the middle of the forming chamber 402 to wet the particulates (130, 130') and discrete fibers (110, 116', 120) prior to dropping.

It is understood that the particulates 130 chosen should be capable of withstanding the heat that the air-laid nonwoven fibrous web 234 is exposed to in order to melt the first region 112 of the multi-component fiber 110. Generally, the heat is provided at or to 100 to 150° C. Further, it is understood that the particulates 130 chosen should be capable of withstanding the mist of liquid solution 214, if included. Therefore, the liquid of the mist may be an aqueous solution, and in another embodiment, the liquid of the mist may be an organic solvent solution.

5. Optional Apparatus for Applying Additional Layers to Air-Laid Fibrous Webs

Exemplary air-laid nonwoven fibrous webs 234 of the present disclosure may optionally include at least one additional layer adjoining the air-laid nonwoven fibrous web 234 comprising a plurality of discrete fibers and a plurality of particulates. The at least one adjoining layer may be an underlayer (e.g. a support layer 232 for the air-laid nonwoven fibrous web 234), an overlayer (e.g. cover layer 230), or a combination thereof. The at least one adjoining layer need not directly contact a major surface of the air-laid nonwoven fibrous web 234, but preferably does contact at least one major surface of the air-laid nonwoven fibrous web 234.

In some exemplary embodiments, the at least one additional layer may be pre-formed, for example, as a web roll (see e.g. web roll 262 in FIG. 1A) produced before forming the air-laid nonwoven fibrous web 234. In other exemplary embodiments, a web roll (not shown) may be unrolled and passed under the forming chamber 402 to provide a collector surface for the air-laid nonwoven fibrous web 234. In certain exemplary embodiments, the web roll 262 may be positioned to apply a cover layer 230 after the air-laid nonwoven fibrous web 234 exits the forming chamber 402, as shown in FIG. 1A.

In other exemplary embodiments, the at least one adjoining layer may be co-formed with the air-laid nonwoven fibrous web 234 using, for example, post-forming applicator 216 which is shown applying a plurality of fibers 218 (which, in some presently preferred embodiments, comprises a population of fibers having a median diameter less than one micrometer) adjoining (preferably contacting) a major surface of air-laid nonwoven fibrous web 234, thereby forming a multilayer air-laid nonwoven fibrous web 234 which, in some embodiments, is useful in manufacturing a filtration article.

As noted above, exemplary air-laid nonwoven fibrous webs 234 of the present disclosure may optionally comprise a population of sub-micrometer fibers. In some presently preferred embodiments, the population of sub-micrometer fibers comprises a layer adjoining the air-laid nonwoven fibrous web 234. The at least one layer comprising a sub-micrometer fiber component may be an underlayer (e.g. a support layer or collector for the air-laid nonwoven fibrous web 234), but more preferably is used as an overlayer or cover layer. The population of sub-micrometer fibers may be co-formed with the air-laid nonwoven fibrous web 234, or may be pre-formed as a web roll before forming the air-laid nonwoven fibrous web 234 and unrolled to provide a collector or cover layer (see e.g. web roll 262 and cover layer 230 in FIG. 1A) for the air-laid nonwoven fibrous web 234, or alternatively or additionally may be post-formed after forming the air-laid nonwoven fibrous web 234, and applied adjoining, preferably overlaying, the air-laid nonwoven fibrous web 234 (see e.g. post-forming applicator 216 applying fibers 218 to air-laid nonwoven fibrous web 234 in FIG. 1A).

In exemplary embodiments in which the population of sub-micrometer fibers is co-formed with the air-laid nonwoven fibrous web 234, the population of sub-micrometer fibers may be deposited onto a surface of the air-laid nonwoven fibrous web 234 so as to form a population of sub-micrometer fibers at or near the surface of the web. The method may comprise a step wherein the air-laid nonwoven fibrous web 234, which optionally may include a support layer or collector (not shown), is passed through a fiber stream of sub-micrometer fibers having a median fiber diameter of less than 1 micrometer (μm). While passing through the fiber stream, sub-micrometer fibers may be deposited onto the air-laid nonwoven fibrous web 234 so as to be temporarily or permanently bonded to the support layer. When the fibers are deposited onto the support layer, the fibers may optionally bond to one another, and may further harden while on the support layer.

The population of sub-micrometer fibers may be co-formed with the air-laid nonwoven fibrous web 234, or may be pre-formed as a web roll (not shown) before forming the air-laid nonwoven fibrous web 234 and unrolled to provide a collector (not shown or cover layer (see e.g. web roll 262 and cover layer 230 in FIG. 1A) for the air-laid nonwoven fibrous web 234, or alternatively or additionally, may be post-formed after forming the air-laid nonwoven fibrous web 234, and applied adjoining, preferably overlaying, the air-laid nonwoven fibrous web 234 (see e.g. post-forming applicator 216 applying fibers 218 to air-laid nonwoven fibrous web 234 in FIG. 1A).

Following formation, the air-laid nonwoven fibrous web 234 passes, in some exemplary embodiments, through the optional heating unit 240, which partially melts and then coalesces the first regions to secure the air-laid nonwoven fibrous web 234 and also secure, in certain exemplary embodiments, the optional particulates (130, 130'). An optional binder coating could also be included in some embodiments. Thus in one exemplary embodiment, the air-laid nonwoven fibrous web 234 could proceed to a post-forming processor 250, for example, a coater wherein a liquid or dry binder could be applied to at least one major surface of the nonwoven fibrous web (e.g. the top surface, and/or the bottom surface) within region 318. The coater could be a roller coater, spray coater, immersion coater, powder coater or other known coating mechanism. The coater could apply the binder to a single surface of the air-laid nonwoven fibrous web 234 or to both surfaces.

If applied to a single major surface, the air-laid nonwoven fibrous web 234 may proceed to another coater (not shown), where the other major uncoated surface could be coated with a binder. It is understood that if an optional binder coating is included, that the particulate should be capable of withstanding the coating process and conditions, and the surface of any chemically active particulates should not be substantially occluded by the binder coating material.

Other post processing steps may be done to add strength or texture to the air-laid nonwoven fibrous web 234. For example, the air-laid nonwoven fibrous web 234 may be needle punched, calendered, hydro-entangled, embossed, or laminated to another material in post-forming processor 250.

B. Methods for Making Air-Laid Nonwoven Fibrous Webs

The disclosure also provides methods of making air-laid nonwoven fibrous webs using the apparatus according to any of the foregoing embodiments.

1. Methods for Opening Fiber Clumps and Forming Air-Laid Fibrous Webs

Thus, in further exemplary embodiments, the disclosure provides methods for making a nonwoven fibrous web 234, including providing an apparatus 220 including an opening chamber 400 and a forming chamber 402 according to any of the previously described apparatus embodiments, introducing a multiplicity of fibers 116 into the opening chamber 400, dispersing the multiplicity of fibers 116 as discrete, substantially non-agglomerated fibers 116' in a gas phase, transporting a population of the discrete, substantially non-agglomerated fibers 116' to the lower end of the forming chamber 402, and collecting the population of discrete, substantially non-agglomerated fibers 116' as a nonwoven fibrous web 234 on a collector surface 319' of a collector 319.

2. Optional Methods for Including Particulates in Air-Laid Fibrous Webs

In any of the foregoing methods, the population of the discrete, substantially non-agglomerated fibers 116' is preferably transported generally upward through the opening chamber 400, into the top of the forming chamber 402, and then transported generally downward through the forming chamber 402 under the force of gravity and optionally, assisted by a vacuum force applied to the collector 319 positioned at the lower end of the forming chamber.

In certain exemplary embodiments, the methods further include introducing a plurality of particulates, which may be chemically active particulates, into the forming chamber and mixing the plurality of substantially non-agglomerated discrete fibers with the plurality of particulates within the forming chamber to form a fibrous particulate mixture before capturing the population of substantially discrete fibers as an air-laid nonwoven fibrous web on the collector, and securing at least a portion of the particulates to the air-laid nonwoven fibrous web. In some exemplary embodiments, the plurality of particulates is introduced into the forming chamber at the upper end, at the lower end, between the upper end and the lower end, or a combination thereof.

However, in certain exemplary embodiments, transporting the fibrous particulate mixture to the lower end of the forming chamber to form an air-laid nonwoven fibrous web comprises dropping additional discrete fibers into the forming chamber and permitting the fibers to drop through the forming chamber under the force of gravity. In other exemplary embodiments, transporting the fibrous particulate mixture to the lower end of the forming chamber to form an air-laid nonwoven fibrous web comprises dropping the discrete fibers into the forming chamber and permitting the fibers to drop through the forming chamber under the forces of gravity and a vacuum force applied to the lower end of the forming chamber.

In certain exemplary embodiments of methods including particulates, the particulates are secured to the nonwoven fibrous web. In some such exemplary embodiments including particulates, a liquid may be introduced into the forming chamber to wet at least a portion of the discrete fibers, whereby at least a portion of the particulates adhere to the wetted portion of the discrete fibers in the forming chamber.

In other exemplary embodiments, a selected bonding method may be used to secure the particulates to the fibers, as described further below. In some such exemplary embodiments preferably more than 0% and less than 10% wt. of the air-laid nonwoven fibrous web, more preferably more than 0% and less than 10% wt. of the discrete fibers, is comprised of multi-component fibers comprising at least a first region having a first melting temperature and a second region having a second melting temperature wherein the first melting temperature is less than the second melting temperature, securing the particulates to the air-laid nonwoven fibrous web comprises heating the multi-component fibers to a temperature of at least the first melting temperature and less than the second melting temperature, whereby at least a portion of the particulates are bonded to the at least first region of at least a portion of the multi-component fibers, and at least a portion of the discrete fibers are bonded together at a plurality of intersection points with the first region of the multi-component fibers.

In other exemplary embodiments wherein the plurality of discrete fibers includes a first population of monocomponent discrete thermoplastic fibers having a first melting temperature, and a second population of monocomponent discrete fibers having a second melting temperature greater than the first melting temperature, securing the particulates to the air-laid nonwoven fibrous web comprises heating the thermoplastic fibers to a temperature of at least the first melting temperature and less than the second melting temperature, whereby at least a portion of the particulates are bonded to at least a portion of the first population of monocomponent discrete fibers, and further wherein at least a portion of the first population of monocomponent discrete fibers is bonded to at least a portion of the second population of monocomponent discrete fibers.

In some exemplary embodiments comprising a first population of monocomponent discrete thermoplastic fibers having a first melting temperature and a second population of monocomponent discrete fibers having a second melting temperature greater than the first melting temperature, preferably more than 0% and less than 10% wt. of the air-laid nonwoven fibrous web, more preferably more than 0% and less than 10% wt. of the discrete fibers, is comprised of the first population of monocomponent discrete thermoplastic.

In certain exemplary embodiments, securing the particulates to the air-laid nonwoven fibrous web comprises heating the first population of monocomponent discrete thermoplastic fibers to a temperature of at least the first melting temperature and less than the second melting temperature, whereby at least a portion of the particulates are bonded to at least a portion of the first population of monocomponent discrete thermoplastic fibers, and at least a portion of the discrete fibers are bonded together at a plurality of intersection points with the first population of monocomponent discrete thermoplastic fibers.

In some of the foregoing embodiments, securing the particulates to the air-laid nonwoven fibrous web comprises entangling the discrete fibers, thereby forming a cohesive air-laid nonwoven fibrous web including a plurality of interstitial voids, each interstitial void defining a void volume having at least one opening having a median dimension defined by at least two overlapping fibers, wherein the particulates exhibit a volume less than the void volume and a median particulate size greater than the median dimension, further wherein the chemically active particulates are not substantially bonded to the discrete fibers and the discrete fibers are not substantially bonded to each other.

Through some embodiments of the process described above, it is possible to obtain the particulates preferentially on one surface of the nonwoven article. For open, lofty nonwoven webs, the particulates will fall through the web and preferentially be on the bottom of the nonwoven article. For dense nonwoven webs, the particulates will remain on the surface and preferentially be on the top of the nonwoven article.

Further, as described above, it is possible to obtain a distribution of the particulates throughout the thickness of the nonwoven article. In this embodiment, the particulate therefore is available on both working surfaces of the web and throughout the thickness. In one embodiment, the fibers can be wetted to aid in the clinging the particulate to the fibers until the fiber can be melted to secure the particulates. In another embodiment, for dense nonwoven webs, a vacuum can be introduced to pull the particulates throughout the thickness of the nonwoven article.

In any of the foregoing embodiments, the particulates may be introduced into the chamber at the upper end, at the lower end, between the upper end and the lower end, or a combination thereof.

3. Optional Bonding Methods for Producing Air-Laid Fibrous Webs

In some exemplary embodiments, the methods further include bonding at least a portion of the plurality of fibers together without the use of an adhesive prior to removal of the web from the collector surface. Depending on the condition of the fibers, some bonding may occur between the fibers before or during collection. However, further bonding between the air-laid fibers in the collected web may be needed or desirable to bond the fibers together in a manner that retains the pattern formed by the collector surface. "Bonding the fibers together" means adhering the fibers together firmly without an additional adhesive material, so that the fibers generally do not separate when the web is subjected to normal handling).

In some exemplary embodiments where light autogenous bonding provided by through-air bonding may not provide the desired web strength for peel or shear performance, it may be useful to incorporate a secondary or supplemental bonding step, for example, point bonding calendering, after removal of the collected air-laid fibrous web from the collector surface. Other methods for achieving increased strength may include extrusion lamination or polycoating of a film layer onto the back (i.e., non-patterned) side of the patterned air-laid fibrous web, or bonding the patterned air-laid fibrous web to a support web (e.g., a conventional air-laid web, a nonporous film, a porous film, a printed film, or the like). Virtually any bonding technique may be used, for example, application of one or more adhesives to one or more surfaces to be bonded, ultrasonic welding, or other thermal bonding methods able to form localized bond patterns, as known to those skilled in the art. Such supplemental bonding may make the web more easily handled and better able to hold its shape.

Conventional bonding techniques using heat and pressure applied in a point-bonding process or by smooth calender rolls may also be used, though such processes may cause undesired deformation of fibers or compaction of the web. An alternate technique for bonding the air-laid fibers is through-air bonding as disclosed in U.S. Pat. App. Pub. No. 2008/0038976 A1 (Berrigan et al.).

In certain exemplary embodiments, bonding comprises one or more of autogenous thermal bonding, non-autogenous thermal bonding, and ultrasonic bonding. In particular exemplary embodiments, at least a portion of the fibers is oriented in a direction determined by the pattern. Suitable bonding methods and apparatus (including autogenous bonding methods) are described in U.S. Pat. App. Pub. No. 2008/0026661 A1 (Fox et al.).

4. Optional Methods for Producing Patterned Air-Laid Fibrous Webs

In some exemplary embodiments, air-laid nonwoven fibrous webs 234 having a two- or three-dimensional patterned surface may be formed by capturing air-laid discrete fibers on a patterned collector surface 319' and subsequently bonding the fibers without an adhesive while on the collector 319, for example, by thermally bonding the fibers without use of an adhesive while on the collector 319 under a through-air bonder 240. Suitable apparatus and methods for producing patterned air-laid nonwoven fibrous webs are described in co-pending U.S. Pat. App. No. 61/362,191 filed Jul. 7, 2010 and titled "PATTERNED AIR-LAID NONWOVEN FIBROUS WEBS AND METHODS OF MAKING AND USING SAME".

5. Optional Methods for Applying Additional Layers to Air-Laid Fibrous Webs

In any of the foregoing embodiments, the air-laid nonwoven fibrous web may be formed on a collector, wherein the collector is selected from a screen, a scrim, a mesh, a nonwoven fabric, a woven fabric, a knitted fabric, a foam layer, a porous film, a perforated film, an array of fibers, a melt-fibrillated nanofiber web, a meltblown fibrous web, a spunbond fibrous web, an air-laid fibrous web, a wet-laid fibrous web, a carded fibrous web, a hydro-entangled fibrous web, and combinations thereof.

In alternative embodiments particularly useful for materials that do not form autogenous bonds to a significant extent, air-laid discrete fibers may be collected on a surface of a collector and one or more additional layer(s) of fibrous material capable of bonding to the fibers may be applied on, over or around the fibers, thereby bonding together the fibers before the fibers are removed from the collector surface.

The additional layer(s) could be, for example, one or more meltblown layers, or one or more extrusion laminated film layer(s). The layer(s) would not need to be physically entangled, but would generally need some level of interlayer bonding along the interface between layer(s). In such embodiments, it may not be necessary to bond together the fibers using through-air bonding in order to retain the pattern on the surface of the patterned air-laid fibrous web.

6. Optional Additional Processing Steps for Producing Air-Laid Fibrous Webs

In other examples of any of the foregoing embodiments, the method further comprises applying a fibrous cover layer overlaying the air-laid nonwoven fibrous web, wherein the fibrous cover layer is formed by air-laying, wet-laying, carding, melt blowing, melt spinning, electrospinning, plexifilament formation, gas jet fibrillation, fiber splitting, or a combination thereof. In certain exemplary embodiments, the fibrous cover layer comprises a population of sub-micrometer fibers having a median fiber diameter of less than 1 μm formed by melt blowing, melt spinning, electrospinning, plexifilament formation, gas jet fibrillation, fiber splitting, or a combination thereof.

In addition to the foregoing methods of making an air-laid fibrous web, one or more of the following process steps may be carried out on the web once formed:

(1) advancing the collected air-laid fibrous web along a process pathway toward further processing operations;

(2) bringing one or more additional layers into contact with an outer surface of the collected air-laid fibrous web;

(3) calendering the collected air-laid fibrous web;

(4) coating the collected air-laid fibrous web with a surface treatment or other composition (e.g., a fire retardant composition, an adhesive composition, or a print layer);

(5) attaching the collected air-laid fibrous web to a cardboard or plastic tube;

(6) winding-up the collected air-laid fibrous web in the form of a roll;

(7) slitting the collected air-laid fibrous web to form two or more slit rolls and/or a plurality of slit sheets;

(8) placing the collected air-laid fibrous web in a mold and molding the patterned air-laid fibrous web into a new shape;

(9) applying a release liner over an exposed optional pressure-sensitive adhesive layer on the collected air-laid fibrous web, when present; and

(10) attaching the collected air-laid fibrous web to another substrate via an adhesive or any other attachment device including, but not limited to, clips, brackets, bolts/screws, nails, and straps.

Exemplary embodiments of air-laid nonwoven fibrous webs optionally including particulates and/or patterns have been described above and are further illustrated below by way of the following Examples, which are not to be construed in any way as imposing limitations upon the scope of the present invention. On the contrary, it is to be clearly understood that resort may be had to various other embodiments, modifications, and equivalents thereof which, after reading the description herein, may suggest themselves to those skilled in the art without departing from the spirit of the present disclosure and/or the scope of the appended claims.

EXAMPLES

Notwithstanding that the numerical ranges and parameters setting forth the broad scope of the disclosure are approximations, the numerical values set forth in the specific examples are reported as precisely as possible. Any numerical value, however, inherently contains certain errors necessarily resulting from the standard deviation found in their respective testing measurements. At the very least, and not as an attempt to limit the application of the doctrine of equivalents to the scope of the claims, each numerical parameter should at least be construed in light of the number of reported significant digits and by applying ordinary rounding techniques.

Materials

TABLE 1

| Example | Trade Designation | Supplier | Material Type | Nominal Fiber Dimensions | Weight (%) |
|---|---|---|---|---|---|
| 1 | T-295 | Invista (Wichita, KS) | Polyethylene Terephthalate Monocomponent (PET) | Denier: 6 Length: 38 mm | 83 |
| 1 | LMF | Huvis (Seoul, South Korea) | PET/PET Bi-component | Denier: 2 Length: 38 mm | 17 |
| 2 | Tarilin | Nan Ya Plastics Corp. (America, SC) | PET | Denier: 1.5 Length: 38 mm | 100 |
| 3 | PF15HT | William Barnet and Son (Arcadia, SC) | PET | Denier: 1.5 Length: 6 mm | 100 |

Test Methods

Basis Weight Measurement

The basis weight for exemplary nonwoven fibrous webs containing chemically active particulates was measured with a weighing scale Mettler Toledo XS4002S, (commercially available from Mettler-Toledo SAS, Viroflay, France).

Preparation of Nonwoven Fibrous Webs

In each of the following Examples, an air-laid web-forming apparatus as generally shown in FIG. 1A was used to prepare nonwoven fibrous webs containing a plurality of discrete non-agglomerated fibers. This apparatus comprises a chamber with four rotating rollers having a plurality of projections extending outwardly from each roller surface, and two gas emission nozzles positioned to direct air streams generally upward and towards the roll-free portion of the chamber on the right hand side of the illustrated apparatus of FIG. 1A.

The fiber conveyor belt 319 was replaced with a flat sheet metal floor, and the fiber-feeding belt 325' was replaced with a stationary stainless steel perforated plate with holes sized at 4 mm in diameter and spaced in a repeating pattern of 7 mm (center-to-center). (2) Two WindJet 39190 gas emission nozzles (Spraying Systems Co., Wheaton, Ill.) were placed beneath the stainless steel perforated plate, with each nozzle approximately 1.5 inches toward the center of the apparatus from each edge, 0.5-1.0 inches beneath the planar surface of the perforated steel plate, and at an inward facing angle as measured from horizontal of about 60°. A configuration involving a second (roll-free) forming chamber was not used; the fibers were recirculated within the fiber opening chamber 400 demonstrate the efficacy of pressurized gas emission nozzles as a means to direct and elutriate the opened, substantially non-agglomerated, discrete fibers 116' upwardly within the opening chamber 400.

Example 1

Nonwoven Fibrous Web

The mono-component polyethylene terephthalate (PET) fibers and the bi-component fibers were dropped into an air-laying forming apparatus as generally shown in FIG. 1A. The PET fibers and the bi-component fibers were fed into an opening at the top of this chamber at 6 grams per batch. The PET fibers were fed at 5 g/batch to this chamber (equal to 83% by weight of the total weight). The bi-component fibers were fed at 1 g/batch to this chamber (equal to 17% by weight of the total weight).

To generate the described example, air was supplied to the two previously described gas emission nozzles at a pressure of 36 PSIG (about 0.248 MPa) and the rollers were rotated at the following rotational directions and rotational velocities:

Top Left (222): Counter clockwise, 25 Hz
Top Right (222'): Clockwise, 25 Hz
Bottom Left (222"): Clockwise, 12 Hz
Bottom Right (222'''): Counter clockwise, 25 Hz The fibrous feed material was released nearly instantaneously via a port in the top of the device, and fell via gravity into the apparatus. The fibrous feed material was opened, combined, and fluffed as it fell through the upper rows of rollers and passed the lower row of rollers. Upon falling within the effective area of influence of the gas emission nozzles, the fibers were propelled upwards and reprocessed by the lower row of rollers followed by the top row of rollers yet again. Fibers were lofted into the air, and then entered the same processing cycle as described above. The specified fiber processing path was repeated until a desired amount of time elapsed (60 seconds), at which point the flow of air through the gas emission nozzles was discontinued and the substantially dispersed fibers were collected via gravity on the perforated floor of the apparatus as a nonwoven web of substantially non-agglomerated discrete fibers.

The web was removed from the apparatus, placed on carrier tissue, and then conveyed into an electric oven (135-140° C.) with a line speed of 1.1 m/min, which melts the sheath of the bi-component fibers. In this example, the web was removed immediately after the oven. The oven is an electric oven from International Thermal Systems, LLC (Milwaukee, Wis.). The oven has one heating chamber of 5.5 meters in length; the principle is air blowing in the chamber from the top. The circulation can be set so that a part of the blown air can be evacuated (20 to 100% setup) and a part can be re-circulated (20-100% setup). In this example the air was evacuated at 60% setting and re-circulated at 40%, the temperature was 137.7° C. in the chambers. The sample was passed once through the chamber, and, upon exit, was compacted with a free spinning silicone coated steel roller set with a gap of 0.5" above the endless belt.

The resulting three-dimensional nonwoven fibrous web of substantially non agglomerated discrete fibers was open and lofty.

Example 2

Nonwoven Fibrous Web

The mono-component PET fibers were dropped into an air-laying forming apparatus as generally shown in FIG. 1A. The PET fibers were fed into an opening at the top of this chamber at 6 grams per batch (equal to 100% by weight of the total weight).

To generate the described example, air was supplied to the two previously described gas emission nozzles at a pressure of 36 PSIG (about 0.248 MPa) and the rollers were rotated at the following rotational directions and rotational velocities:

Top Left (222): Counter clockwise, 20 Hz
Top Right (222'): Clockwise, 20 Hz
Bottom Left (222"): Clockwise, 20 Hz
Bottom Right (222'''): Counter clockwise, 20 Hz The fibrous feed material was released nearly instantaneously via a port in the top of the device, and fell via gravity into the apparatus. The fibrous feed material was opened, combined, and fluffed as it fell through the upper rows of rollers and passed the lower row of rollers. Upon falling within the effective area of influence of the gas emission nozzles, the fibers were propelled upwards and reprocessed by the lower row of rollers followed by the top row of rollers yet again. Fibers were repeatedly lofted into the air, and then reentered the same processing cycle as described above. The specified fiber processing path was repeated until a desired amount of time elapsed.

Example 3

Nonwoven Fibrous Web

The mono-component PET fibers were dropped into an air-laying forming apparatus as generally shown in FIG. 1A. The PET fibers were fed into an opening at the top of this chamber at 6 grams per batch (equal to 100% by weight of the total weight).

To generate the described example, air was supplied to the two previously described gas emission nozzles at a pressure of 36 PSIG (about 0.248 MPa) and the rollers were rotated at the following rotational directions and rotational velocities:

Top Left (222): Counter clockwise, 15 Hz
Top Right (222'): Counter clockwise, 15 Hz
Bottom Left (222"): Clockwise, 40 Hz
Bottom Right (222'''): Counter clockwise, 40 Hz The fibrous feed material was released nearly instantaneously via a port in the top of the device, and fell via gravity into the apparatus. The fibrous feed material was opened, combined, and fluffed as it fell through the upper rows of rollers and passed the lower row of rollers. Upon falling within the effective area of influence of the gas emission nozzles, said fibers were propelled upwards and reprocessed by the lower row of rollers followed by the top row of rollers yet again. Fibers were repeatedly lofted into the air, and then reentered the same processing cycle as described above. A third (annular) gas emission nozzle was used at the top of the chamber to propel lofted, low-density fiber bits and substantially non-agglomerated, well-dispersed discrete fibers out of the chamber via a 4-inch diameter side port located 11.75 inches (center-to-center) above the top row of rollers.

While the specification has described in detail certain exemplary embodiments, it will be appreciated that those skilled in the art, upon attaining an understanding of the foregoing, may readily conceive of alterations to, variations of, and equivalents to these embodiments. Accordingly, it should be understood that this disclosure is not to be unduly limited to the illustrative embodiments set forth hereinabove. Furthermore, all publications, published patent applications and issued patents referenced herein are incorporated by reference in their entirety to the same extent as if each individual publication or patent was specifically and individually indicated to be incorporated by reference. Various exemplary embodiments have been described. These and other embodiments are within the scope of the following listing of disclosed embodiments.

The invention claimed is:

1. An apparatus comprising:

A fiber opening chamber having an open upper end and a lower end, at least one fiber inlet for introducing a plurality of fibers into the opening chamber;

a first plurality of rollers positioned within the opening chamber, each of the first plurality of rollers having a center axis of rotation, a circumferential surface, and a plurality of projections extend outwardly from the circumferential surface;

at least one gas emission nozzle positioned substantially below the first plurality of rollers to direct a gas stream generally towards the open upper end of the opening chamber; and a forming chamber having an upper end and a lower end, wherein the upper end of the forming chamber is in flow communication with the upper end of the opening chamber, and the lower end of the forming chamber is substantially open and positioned above a collector having a collector surface.

2. The apparatus according to claim 1, further comprising a stationary screen positioned within the forming chamber above the collector surface.

3. The apparatus according to claim 1, further comprising a stationary screen positioned within the opening chamber under the first plurality of rollers.

4. The apparatus of claim 1, wherein the at least one gas emission nozzle comprises a plurality of gas emission nozzles.

5. The apparatus of claim 1, wherein each of the first plurality of rollers is aligned in a horizontal plane extending through the center axis of rotation of each of the first plurality of rollers.

6. The apparatus of claim 1, further comprising a second plurality of rollers positioned within the opening chamber above the first plurality of rollers, each of the second plurality of rollers having a center axis of rotation, a circumferential surface, and a plurality of projections extending outwardly from the circumferential surface.

7. The apparatus of claim 6, wherein each of the second plurality of rollers is aligned in a horizontal plane extending through the center axis of rotation of each of the second plurality of rollers.

8. The apparatus of claim 7, wherein each of the second plurality of rollers rotates in a direction which is opposite to a direction of rotation for each adjacent roller in the horizontal plane extending through each center axis of rotation of the second plurality of rollers.

9. The apparatus of claim 8, wherein the center axis of rotation for one of each of the first plurality of rollers is vertically aligned with the center axis of rotation for a corresponding roller selected from the second plurality of rollers in a plane extending through the center axis of rotation for the one of the first plurality of rollers and the corresponding roller selected from the second plurality of rollers.

10. The apparatus of claim 9, wherein each one of the first plurality of rollers rotates in a direction which is opposite to a direction of rotation for each adjacent roller in the horizontal plane extending through the center axis of rotation of each of the first plurality of rollers, and further wherein each of the first plurality of rollers rotates in a direction which is opposite to a direction of rotation for each corresponding roller selected from the second plurality of rollers, optionally wherein the fiber inlet is positioned above the collector surface.

11. The apparatus of claim 7, wherein each of the second plurality of rollers rotates in a direction which is the same as a direction of rotation for each adjacent roller in the horizontal plane extending through each center axis of rotation of the second plurality of rollers.

12. The apparatus of claim 11, wherein the center axis of rotation for one of each of the first plurality of rollers is vertically aligned with the center axis of rotation for a corresponding roller selected from the second plurality of rollers in a plane extending through the center axis of rotation for the one of the first plurality of rollers and the corresponding roller selected from the second plurality of rollers, wherein each one of the first plurality of rollers rotates in a direction which is opposite to a direction of rotation for each adjacent roller in the horizontal plane extending through the center axis of rotation of each of the first plurality of roller, optionally wherein the fiber inlet is positioned below the first plurality of rollers.

13. The apparatus according claim 1, wherein each projection has a length, and further wherein at least a portion of at least one projection of each of the first plurality of rollers lengthwise overlaps with at least a portion of at least one projection of one of the second plurality of rollers.

14. The apparatus according to claim 13, wherein the lengthwise overlap corresponds to at least 90% of the length of at least one of the overlapping projections.

15. The apparatus according to claim 13, wherein at least a portion of one projection of each of the second plurality of rollers lengthwise overlaps with at least a portion of one projection of an adjacent roller of the second plurality of rollers.

16. The apparatus according to claim 15, wherein the lengthwise overlap corresponds to at least 90% of the length of at least one of the overlapping projections.

17. The apparatus according to claim 13, wherein at least a portion of at least one projection of each of the first plurality of rollers lengthwise overlaps with at least a portion of at least one projection of an adjacent roller of the first plurality of rollers.

18. The apparatus according to claim 17, wherein the lengthwise overlap corresponds to at least 90% of the length of at least one of the overlapping projections.

19. The apparatus of claim 18, wherein the at least one fiber inlet comprises an endless belt for introducing the plurality of fibers into the lower end of the opening chamber optionally further comprising a compression roller for applying a compressive force to the plurality of fibers on the belt before introducing the plurality of fibers into the lower end of the opening chamber.

20. A method for making a nonwoven fibrous web, comprising:

providing an apparatus comprising:

a fiber opening chamber having an open upper end and a lower end, at least one fiber inlet for introducing a plurality of fibers into the opening chamber;

a first plurality of rollers positioned within the opening chamber, each of the first plurality of rollers having a center axis of rotation, a circumferential surface, and a plurality of projections extend outwardly from the circumferential surface;

at least one gas emission nozzle positioned substantially below the first plurality of rollers to direct a gas stream generally towards the open upper end of the opening chamber; and a forming chamber having an upper end and a lower end, wherein the upper end of the forming chamber is in flow communication with the upper end of the opening chamber, and the lower end of the forming chamber is substantially open and positioned above a collector having a collector surface;

introducing a plurality of fibers into the opening chamber;

dispersing the plurality of fibers as discrete, substantially non-agglomerated fibers in a gas phase;

transporting a population of the discrete, substantially non-agglomerated fibers to the lower end of the forming chamber; and collecting the population of discrete, substantially non-agglomerated fibers as a nonwoven fibrous web on a collector surface.

* * * * *